United States Patent [19]

Okumura et al.

[11] 4,392,371

[45] Jul. 12, 1983

[54] METHOD OF PLATE ROLLING AND EQUIPMENT THEREFOR

[75] Inventors: Taketo Okumura; Taiji Tsukahara; Takashi Mikuriya; Hideki Watanabe; Katsutoshi Katada, all of Chiba, Japan

[73] Assignee: Kawasaki Steel Corporation, Kobe, Japan

[21] Appl. No.: 414,838

[22] Filed: Sep. 3, 1982

Related U.S. Application Data

[63] Continuation of Ser. No. 167,122, Jul. 9, 1980, abandoned.

[30] Foreign Application Priority Data

Jul. 13, 1979 [JP] Japan ..... 54-89567

[51] Int. Cl.[3] ..... B21B 1/02

[52] U.S. Cl. ..... 72/231; 72/366

[58] Field of Search ..... 72/199, 226, 227, 231, 72/243, 248, 365, 366

[56] References Cited

U.S. PATENT DOCUMENTS

| | | | |
|---|---|---|---|
| 1,825,957 | 10/1931 | Johnson | 72/248 |
| 2,526,475 | 10/1950 | Glesmann | 72/248 |
| 4,238,946 | 12/1980 | Tsubota | 72/366 |

*Primary Examiner*—Lowell A. Larson

*Attorney, Agent, or Firm*—Koda and Androlia

[57] ABSTRACT

This invention relates to a method of plate rolling, wherein, in plate rolling, a value corresponding to the difference in width between the center and the end portions of a material to be rolled is estimated and calculated, sizing rolling is carried out by subjecting the material to plate rolling of plan view pattern control only at the opposite end portions thereof with a difference in gap between upper and lower work rolls in the axial direction thereof corresponding to said value, and to an equipment for use in said method.

4 Claims, 14 Drawing Figures

METHOD OF PLATE ROLLING AND EQUIPMENT THEREFOR

This is a continuation of application Ser. No. 167,122, filed July 9, 1980, now abandoned.

BACKGROUND OF THE INVENTION

1. Field of the Invention

This invention relates to improvements in a method of plate rolling with a plate mill and an equipment therefor, and particularly to a method of plate rolling of plan view pattern control and an equipment therefor.

2. Description of the Prior Art

In general, in the case a rolling width is larger than the width of a slab to be rolled, a rolling in the transverse direction to the axis of the final rolling, i.e., a broadside rolling is effected to obtain a required rolling width, and thereafter, a rolling in the longitudinal direction, i.e., a final rolling to obtain a required rolling thickness.

However, at this time of broadside rolling, a difference in width between the opposite end portions and the center of the plate (hereinafter referred to as a "side crop") is produced, and it is known that this side crop is increased in proportion to the increase in a broadside rolling ratio (rolling width/material width) as shown in FIG. 1.

If the side crop as described above is increased, then problems such as misshaping and the like are caused to the plate after the rolling, thus causing a decrease in the yield.

Now, as the methods of decreasing the side crop as described above, heretofore, there have been proposed (1) a method wherein corners of opposite end portions of a plate are bulged out by effecting a rolling in the longitudinal direction (sizing pass) before a broadside rolling, and thereafter, a broadside rolling is effected in the transverse direction so as to decrease the side crops, (2) a method wherein roll crowns are formed into minus crowns, whereby the reduction at the central portions is decreased as compared with that at the opposite end portions of the plate after the broadside rolling, so as to decrease the side crops, and the like.

In the conventional method (1), if the reduction of the sizing pass is increased before the broadside rolling, then the side crop may be decreased, however, the reduction will be restricted. More specifically, the rolling width after the broadside rolling will be given by the following equation (1), thereby limiting the reduction of the sizing pass due to the length of roll barrel.

$$\text{Rolling width after broadside rolling} = \text{Slab length} \times \text{Slab thickness}/(\text{Slab thickness} - \text{reduction of the sizing pass}) < \text{Length of roll barrel} \quad (1)$$

Furthermore, in the aforesaid conventional method (2), it is necessary to form the roll crowns into minus crowns in accordance with the side crop. On the other hand, since the side crop is varied according to the broadside rolling ratio, it is necessary to prepare rolls having various types of roll crowns. Futher, even if the rolls having various types of roll crowns are prepared, roll profiles are varied due to wear of rolls, so that it is very difficult to obtain proper side crops.

SUMMARY OF THE INVENTION

The present invention has been developed to obviate the abovedescribed disadvantages of the prior art and has as its object the provision of a method of plate rolling and an equipment therefor, in which the production of side crops in plate rolling and the misshaping of the plate are eliminated to improve the yield. Further, another object of the present invention is to provide numerical formulae to determine the inclinations of the rolles for plate rolling of plan view pattern control (hereinafter referred to as the "plate rolling of the invention") to decrease the occurrence of side crops.

To accomplish the abovedescribed objects, the method of plate rolling of the invention is characterized by rolling only on the opposite end portions, with a difference in gap between the upper and lower work rolls in the axial direction thereof corresponding to the difference in width between the center and the opposite end portions of the plate.

More specifically, according to the present invention, a gap between the upper and lower work rolls in the axial direction thereof is varied by the value corresponding to the side crop, whereby the opposite end portions (the opposite end portions in the widthwise direction after broadside rolling) of the plate are decreased in thickness by the value of the side crop, so that the opposite end portions of the plate can be more broadside-rolled by a value as much as the side crop, thus enabling to decrease the side crop. Additionally, the positioning of screws for varying the gap between work rolls in the axial direction thereof is effected by a process computer for taking into account the side crop, barrel shape, reduction of the sizing pass, roll profiles (roll wear and thermal expansion) and the like, so that the abovedescribed disadvantages of the prior art (1) and (2) can be obviated at all.

Furthermore, the plate rolling equipment according to the present invention is characterized by:

upper and lower work rolls;

reduction screws for applying reduction forces to roll chocks of said upper work roll;

gears connected to said reduction screws;

motors connected to said gears;

encoders connected to said gears through reduction position meters;

automatic reduction setting devices connected to said encoders;

a process computer connected to said automatic reduction setting meters; and a reduction control system connected to said motors, said automatic reduction setting devices and said process computer.

As described above, according to the present invention, the side crop of a material to be rolled for plate rolling is decreased to a large extent, so that the yield can be improved to a considerble extent, and moreover, misshaping and the like of the plate can be effectively prevented from occurring.

BRIEF DESCRIPTION OF THE DRAWINGS

The abovementioned features and objects of the present invention will become more apparent by referring to the following description taken in conjunction with the accompanying drawings, wherein like reference numerals denote like elements and in which.

DETAILED DESCRIPTION OF THE INVENTION

Figure 1:
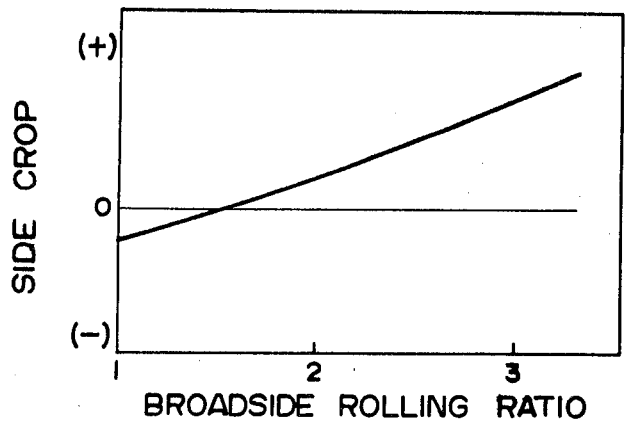
FIG. 1 shows the relationship between the side crop and the broadside rolling ratio.

Description will hereunder be given of the present invention with reference to an embodiment shown in the drawings.

Figure 2:
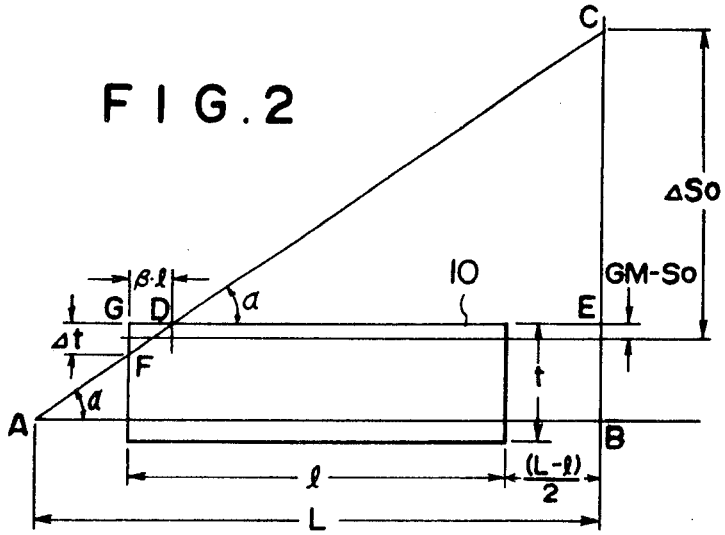
FIG. 2 is a schematic view showing the method of calculating the rolling angle between the work rolls in the axial direction thereof for plate rolling of the invention of the material to be rolled.

Firstly, according to the present invention, as shown in FIG. 2, the first step is calculation of a roll gap difference (a difference in position ΔSo between the right and left screws of the rolls and an angle α of the upper work roll) in the axial direction between the work rolls commensurate to the side crop and the convex shape of the material 10 to be rolled for the plate rolling of the invention. Next, the second step is calculation of a value (Δt as shown in FIG. 2) to be decreased commensurate to the side crop of the material 10 to be rolled. Further, the third step is to subject one end portion of the material to be rolled in the widthwise direction to the plate rolling of the invention (the rolling by inclining rolls after broadside rolling or that after sizing rolling) after determining the positions of the screws for the work rolls based on the calculations obtained in said first and second steps. Then, the fourth step is to subject the other end portion of the material to be rolled to the plate rolling of the invention after determining the positions of the screws for the work rolls based on the calculations obtained in said first and second steps. Finally, the fifth step is to turn the material 10 to be rolled through 90°, subject same to rolling perpendicularly to the direction of the plate rolling of the invention and further subject same to the sizing rolling to eliminate the difference in thickness caused by the plate rolling of the invention. Additionally, in the case calculation is actually made on the positions of the screws for the work rolls, said first and second steps are simultaneously carried out.

Figure 3:
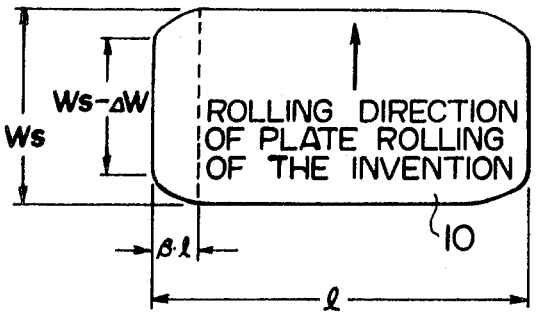
FIG. 3 is a schematic view showing the conditions of the material to be rolled during plate rolling of the invention as viewed from the horizontal direction.

Description will hereunder be given of calculation of the positions of the screws for the work rolls with reference to FIGS. 2 and 3.

Firstly, a difference in gap between the upper and lower work rolls in the axial direction thereof, i.e., a difference in position ΔSo between the right and left screws of the rolls and an inclination α of the upper work roll from the horizontal direction are given from ΔDEC by the following equation.

$$\tan\alpha = \frac{\Delta So - (GM - So)}{l + \frac{L+l}{2} - \beta \cdot l} \tag{2}$$

wherein

ΔSo: a difference in position between the right and left screws for the rolls (mm), So: positions of the screws immediately after broadside rolling (mm), GM: a thickness of the material immediately after broadside rolling (mm), l: a length of the material to be rolled immediately after sizing rolling (mm), β: a side crop correction factor (experimentally, about 12% of l upon completion of the broadside rolling), and L: a distance between the centers of the roll bearings.

Furthermore, the difference ΔSo in position between the right and left screws for the rolls may be given from the abovementioned equation (2) as shown below.

$$\Delta So = \left(\frac{L+l}{2} - \beta \cdot l\right) \cdot \tan\alpha + (GM - So) \tag{3}$$

Further, from ΔDGF, it leads to the following.

$$\tan\alpha = \frac{\Delta t}{\beta \cdot t} \tag{4}$$

Further, from FIG. 3, a required value Δt to be decreased from the end portion of the material 10 to be rolled during the plate rolling of the invention is given by the equation (5) as shown below.

Here, FIG. 3 is a view showing the convex shape assumed upon completion of the broadside rolling of the material to be rolled.

$$\Delta t = \frac{\Delta W}{Ws} \times t \tag{5}$$

wherein

Ws: a width of the material to be rolled immediately after broadside rolling, and t: a thickness of the material to be rolled upon completion of the broadside rolling.

From the abovementioned equations (3), (4) and (5), ΔSo may be given as shown below.

$$\Delta So = \left(\frac{L+l}{2} - \beta \cdot l\right) \times \frac{\Delta W \cdot t}{\beta \cdot l \cdot Ws} + (GM - So) \tag{6}$$

Further, from the equations (4) and (5), it leads to the following.

$$\alpha = \tan^{-1}\frac{\Delta W \cdot t}{\beta \cdot l \cdot Ws} \tag{7}$$

At the right sides of the abovementioned equations (6) and (7), the side crop ΔW is varied depending upon the changes in the broadside rolling ratio, in the reduction of sizing pass and in the roll profile. However, ΔW is stored in the process computer as a function in the following equation (8), so that ΔSo in the aforesaid equation (6) and $\alpha$ in the equation (7) can be automatically calculated by the process computer.

$$\Delta W = f(W_d/Ws, \Delta Ts, \Delta R) \quad (8)$$

wherein $W_r$: a required rolling width (mm), $W_r/Ws$: a broadside rolling ratio, $\Delta Ts$: a reduction of sizing pass (mm), and $\Delta R$: a varied value in the roll profile.

Figure 5:
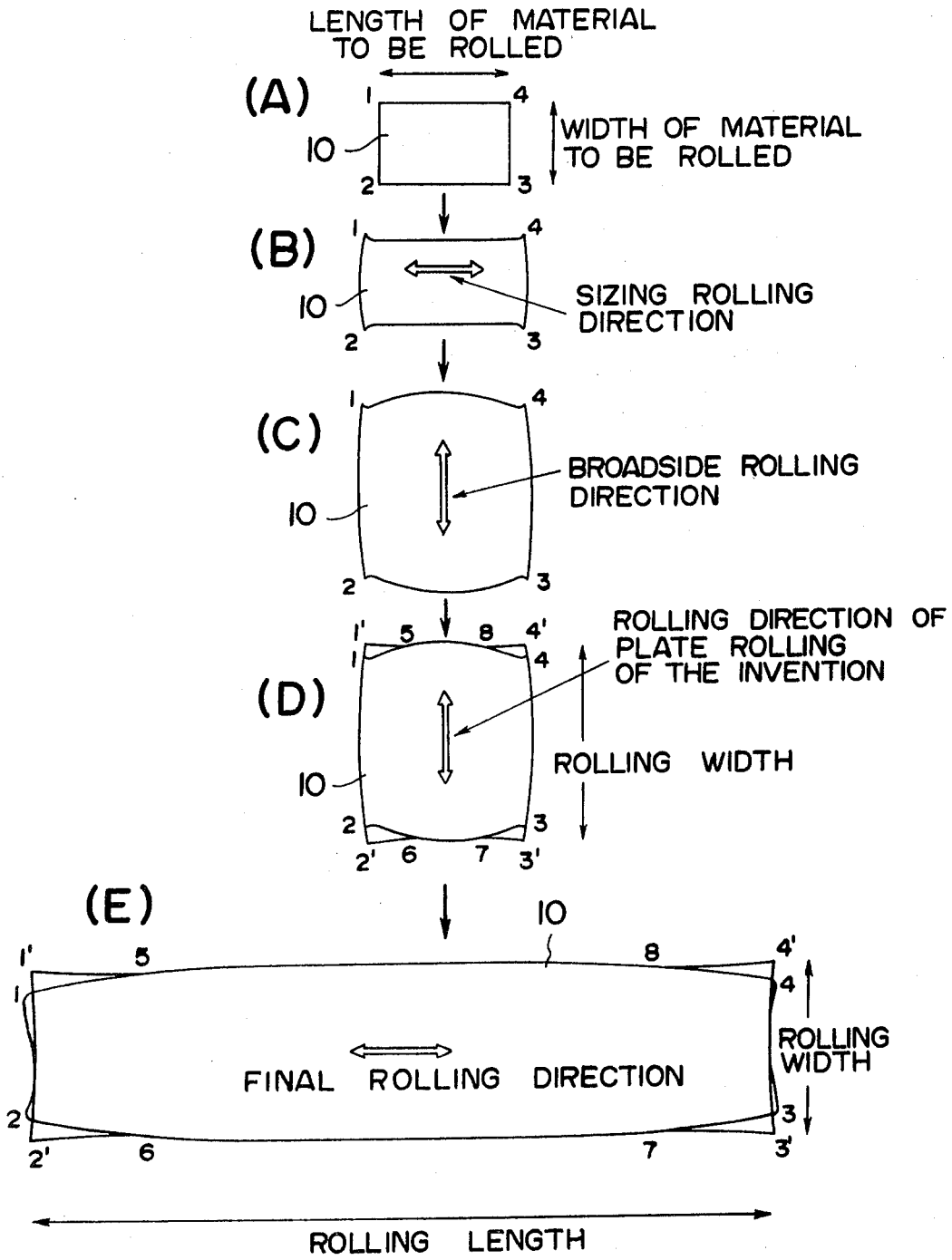
FIGS. 5(A) to 5(E) show a flow chart of rolling successively illustrating the steps of plate rolling in an embodiment of the present invention.

Description will hereunder be given of the changes in the material to be rolled and in the plate in the process of the plate rolling according to the present invention with reference to FIG. 5

(1) Numeral signs 1, 2, 3 and 4 are assigned to the corners of the end portions of the material 10 to be rolled as shown in FIG. 5(A). If the material 10 to be rolled as described above is subjected to the sizing rolling in the directions indicated by arrows in FIG. 5(B), then the corners 1, 2, 3 and 4 of the end portions of the material 10 to be rolled will bulge out as shown. In this case, the bulgings of the corners 1, 2, 3 and 4 of the end portions take place very naturally under the sizing rolling.

(2) Next, when the required rolling width is obtained by carrying out the broadside rolling in the directions indicated by arrows in FIG. 5(C), the lines between 1 and 4 and between 2 and 3 out of the corners of the end portions of the material 10 to be rolled bulge out to provide convex shapes as shown.

Figure 4:
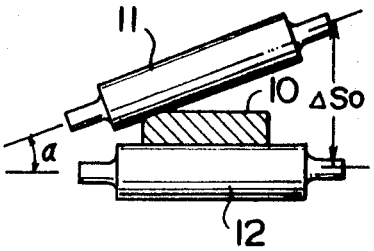
FIG. 4 shows the relationship between the material to be rolled and the work rolls during plate rolling of the invention.

(3) Subsequently, the end portions of the material 10 to be rolled are subjected to the plate rolling of the invention according to the present invention. In this case, out of two work rolls including the upper work roll 11 and the lower work roll 12 for rolling the material 10, the work rolls effects the plate rolling of the invention of the end portions in the axial direction of the material 10 in a condition where the upper work roll 11 is inclined by the difference in angle $\alpha$ in the axial direction corresponding to the side crop with the difference in position between the right and left screws being $\Delta So$ as shown in FIG. 4. In the plate rolling of the invention, squares 1265 and 4378 at the end portions of the material 10 are subjected to the plate rolling of the invention in the directions indicated by arrows in FIG. 5(D), whereby the square 1265 is turned to be one 1'2'65 and the square 4378 is turned to be one 4'3'78, thus enabling to obviate the problem of the convex shape.

(4) Thereafter, the material 10 is subjected to a final rolling to have a required plate thickness as indicated by arrows in FIG. 5(E), so that a plate being of a square 1'2'3'4' without having a convex shape can be obtained.

AN EXAMPLE

Next, Table 1 shows the results of the rolling the material for plate rolling in accordance with the abovedescribed procedural steps followed by the present inventor. It becomes apparent from this Table 1 that, according to the present invention, it is possible to efficiently roll out a plate without having a convex shape.

The present invention is characterized in that, in the plus area of the side crop as shown in FIG. 1, the work rolls are inclined to each other by the value corresponding to the difference in side crop upon completion of the broadside rolling or before the broadside rolling, so that the end portions of the material 10 can be decreased in thickness under the plate rolling of the invention. This side crop is a function of the broadside rolling ratio, of the reduction of sizing rolling and of the roll profile as shown in the abovementioned equation (8). According to the present invention, this function is applied to the abovementioned equation (6) in carrying out the rolling with the difference in gap between the work rolls in the axial direction thereof corresponding to the difference in side crop, so that a loss ratio in area due to the side crop can be made to approach zero even if the material has the side crop and is of a convex shape. (loss ratio in area due to the $$\text{side crop} = \frac{\text{cut away area at opposite ends}}{\text{total area}} \times 100\ (\%))$$

TABLE 1

| EXAMPLE | DIMENSIONS OF MATERIAL TO BE ROLLED mm | DIMENSIONS OF ROLLING mm | BROADSIDE ROLLING RATIO (Wr/Ws) mm | REDUCTION OF SIZING ROLLING ($\Delta$Ts) mm | POSITIONS OF SCREWS UPON COMPLETION OF BROADSIDE ROLLING (t) mm | DIFFERENCE IN GAP BETWEEN ROLLS ($\Delta$So) mm |
|---|---|---|---|---|---|---|
| EXAMPLE (1) | 200 × 1900 × 3060 | 11.17 × 3764 × 24800 | 1.98 | 21.5 | 85.5 | 16.1 |
| COMPARED MATERIAL IN EXAMPLE (1) | 200 × 1900 × 3060 | 11.17 × 3764 × 24800 | 1.98 | 22.0 | 85.1 | 0 |
| EXAMPLE (2) | 200 × 1894 × 3240 | 12 × 3048 × 30480 | 1.61 | 6.4 | 117.2 | 11.7 |
| COMPARED MATERIAL IN EXAMPLE (2) | 200 × 1894 × 3230 | 12 × 3048 × 30480 | 1.61 | 7.0 | 115.6 | 0 |

| SIDE CROP | | | DISTANCE BETWEEN |
|---|---|---|---|
| ACTUAL SIDE CROP | MEAN ACTUAL SIDE CROP | LOSS RATIO OF AREA | CENTERS OF ROLL BEARINGS (L) |

TABLE 1-continued

| EXAMPLE | mm | mm | % | mm | Remarks |
|---|---|---|---|---|---|
| EXAMPLE (1) | 55 | 33 | 0.82 | 4320 | 50 kg steel |
| COMPARED MATERIAL IN EXAMPLE (1) | 121 | 100 | 2.55 | " | 50 kg steel |
| EXAMPLE (2) | 43 | 20 | 0.65 | " | 40 kg steel |
| COMPARED MATERIAL IN EXAMPLE (2) | 56 | 41 | 1.31 | " | 40 kg steel |

In the case of the abovedescribed embodiment, the plate rolling of the invention for correcting the difference in side crop is carried out upon completion of the broadside rolling. However, it is possible that, before the broadside rolling is carried out, the possible side crop, which would be produced during broadside rolling, is estimated in advance, and the opposite end portions of the material is subjected to the plate rolling of the invention to be decreased in thickness, so that the production of side crop, which would otherwise be observed due to the broadside rolling and the like, can be controlled within the tolerance limit. FIGS. 6(A) to 6(F) show an embodiment of he present invention in that case, which will be described hereinafter. In this case also, the abovedescribed equations (2) to (8) can be utilized for calculation of the required decrease in thickness for the plate rolling of the invention, the difference in gap between the work rolls in the axial direction thereof and the like, and hence, the detailed description thereof will be omitted.

Figure 6:
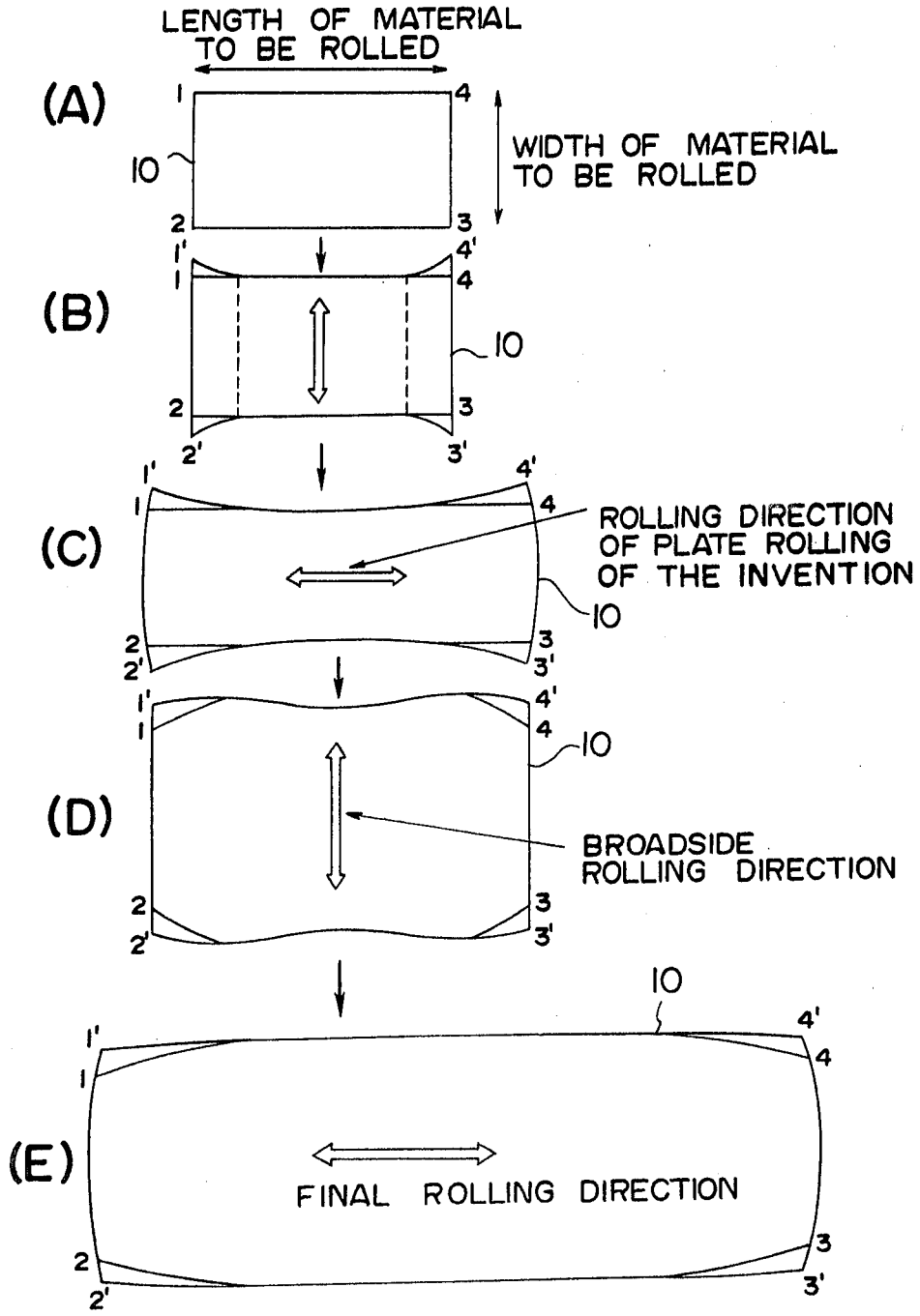
FIGS. 6(A) to 6(E) show a flow chart of rolling in another embodiment of the present invention.

(1) Also, in the case of this example, the corners of the respective end portions of the material 10 to be rolled are assigned with numeral signs 1, 2, 3 and 4 as in FIG. 6(A). If the plate rolling of the invention is applied to the end portions of the material 10 as described above in the directions indicated by arrows in FIG. 6(B), then the corners 1, 2, 3 and 4 of the end portions of the material 10 bulge out as indicated by 1', 2', 3' and 4'. In this case, the two work rolls including the upper work roll 11 and the lower work roll 12 for rolling the material 10, effect the plate rolling of the invention on the end portions of the material 10 (the portions outwardly of two broken lines in the longitudinal direction in FIG. 6(B) in a condition where the upper work roll 11 is inclined by the difference in angle $\alpha$ in the axial direction corresponding to the estimated side crop with the difference in position between the right and left screws being $\Delta So$ as shown in FIG. 4.

(2) Next, the sizing rolling in the directions indicated by arrows in FIG. 6(C) is carried out, whereby the plate thickness reduced portions of the material 10 due to the plate rolling of the invention of the end portions are flattened in the longitudinal direction.

(3) Further, the material 10 is subjected to the broadside rolling as shown in FIG. 6(D), thereby enabling to obtain a required rolling width.

(4) Thereafter, the material 10 is subjected to the final rolling to a required plate thickness as indicated by arrows in FIG. 6(E), so that a plate being of a square 1', 2', 3' and 4' without having a convex shape can be obtained.

ANOTHER EXAMPLE

Next, Table 2 shows the results of the rolling the material for plate rolling in accordance with the procedural steps as described above and shown in FIGS. 6(A) to 6(E), which were followed by the present inventor. It becomes apparent from this Table 2 that, in the case of this example also, a satisfactory plate without having a convex shape can be obtained.

Description will hereunder be given of the control system for carrying out the abovedescribed method according to the present invention.

Figure 7:
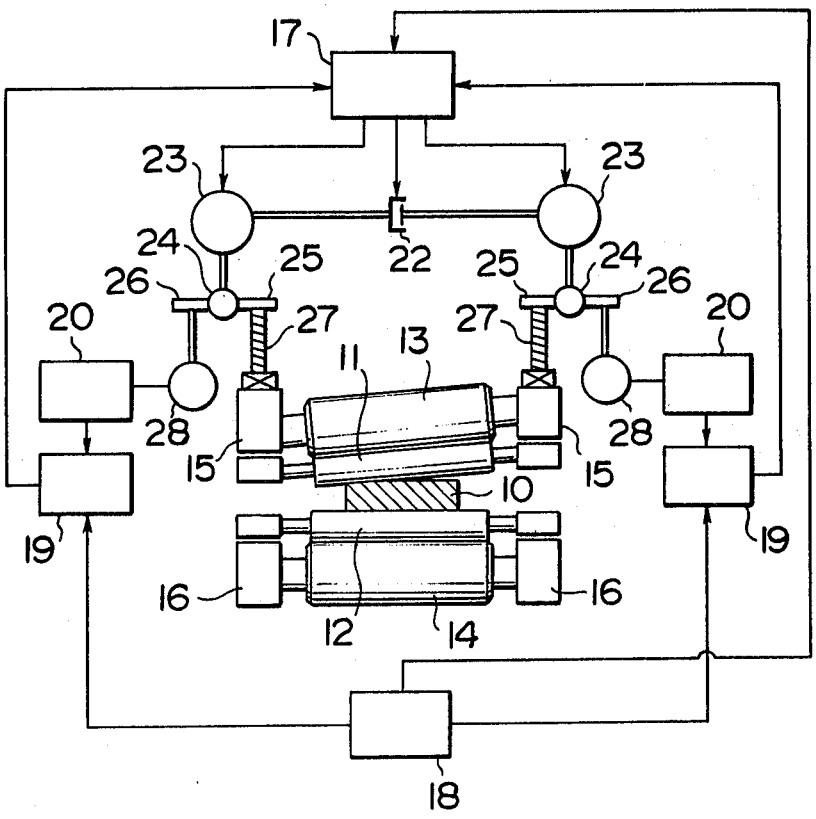
FIG. 7 is an explanatory view showing the outline of the reduction control system for working the method of the present invention.

FIG. 7 is an explanatory view showing an example of the control system for carrying out the method according to the present invention. In FIG. 7, the material 10 to be rolled is under a condition where it is subjected to the plate rolling of the invention by the upper and lower work rolls 11 and 12 in the same manner as in FIG. 4. Designated at reference numerals 13, 14 are backup rolls, and 15, 16 roll chocks on the driving side and the operating side.

TABLE 2

| EXAMPLE | DIMENSIONS OF MATERIAL TO BE ROLLED mm | DIMENSIONS OF ROLLING mm | BROADSIDE ROLLING RATIO (Wr/Ws) mm | REDUCTION OF SIZING ROLLING ($\Delta$Ts) mm | POSITIONS OF SCREWS UPON COMPLETION OF BROADSIDE ROLLING (t) mm |
|---|---|---|---|---|---|
| EXAMPLE (1) | 260 × 1700 × 3230 | 36 × 3000 × 12192 | 1.76 | 45 | 250 |
| COMPARED MATERIAL IN EXAMPLE (1) | 260 × 1700 × 3230 | 36 × 3000 × 12192 | 1.76 | 45 | — |
| EXAMPLE | 200 × 1570 × 2960 | 9 × 3048 × 30480 | 1.94 | 30 | 190 |

TABLE 2-continued

| | | | | | |
|---|---|---|---|---|---|
| (2) COMPARED MATERIAL IN EXAMPLE (2) | 200 × 1570 × 2930 | 9 × 3048 × 30480 | 1.94 | 30 | — |

| EXAMPLE | DIFFERENCE IN GAP BETWEEN ROLLS (ΔSo) mm | SIDE CROP DEVIATION IN WIDTH mm | SIDE CROP LOSS RATIO OF AREA % | DISTANCE BETWEEN CENTERS OF ROLL BEARINGS (L) mm |
|---|---|---|---|---|
| EXAMPLE (1) | 10 | 28 | 0.90 | 4320 |
| COMPARED MATERIAL IN EXAMPLE (1) | — | 72 | 2.31 | 4320 |
| EXAMPLE (2) | 10 | 23 | 0.71 | 4320 |
| COMPARED MATERIAL IN EXAMPLE (2) | — | 43 | 1.35 | 4320 |

A reduction control unit for applying reduction forces to the roll chocks 15, 16 on the driving and operating sides includes a reduction control system 17, a process computer 18 for feeding an inclinated reduction signal to said reduction control system 17, automatic reduction setting devices (reduction APC) 19 and encoders 20. Furthermore, said reduction control system 17 is connected to two motors 23 on the driving and operating sides, which are connected through an electromagnetic clutch 22 to each other, the both motors 23 are each connected to two gears 25, 26 through a gear 24, one 25 of the gears is connected to a reduction screw 27 for applying a reduction force to the roll chock 15, and the other 26 of the gears is connected to the encoder 20 through a reduction position sensor 28.

Figure 8:
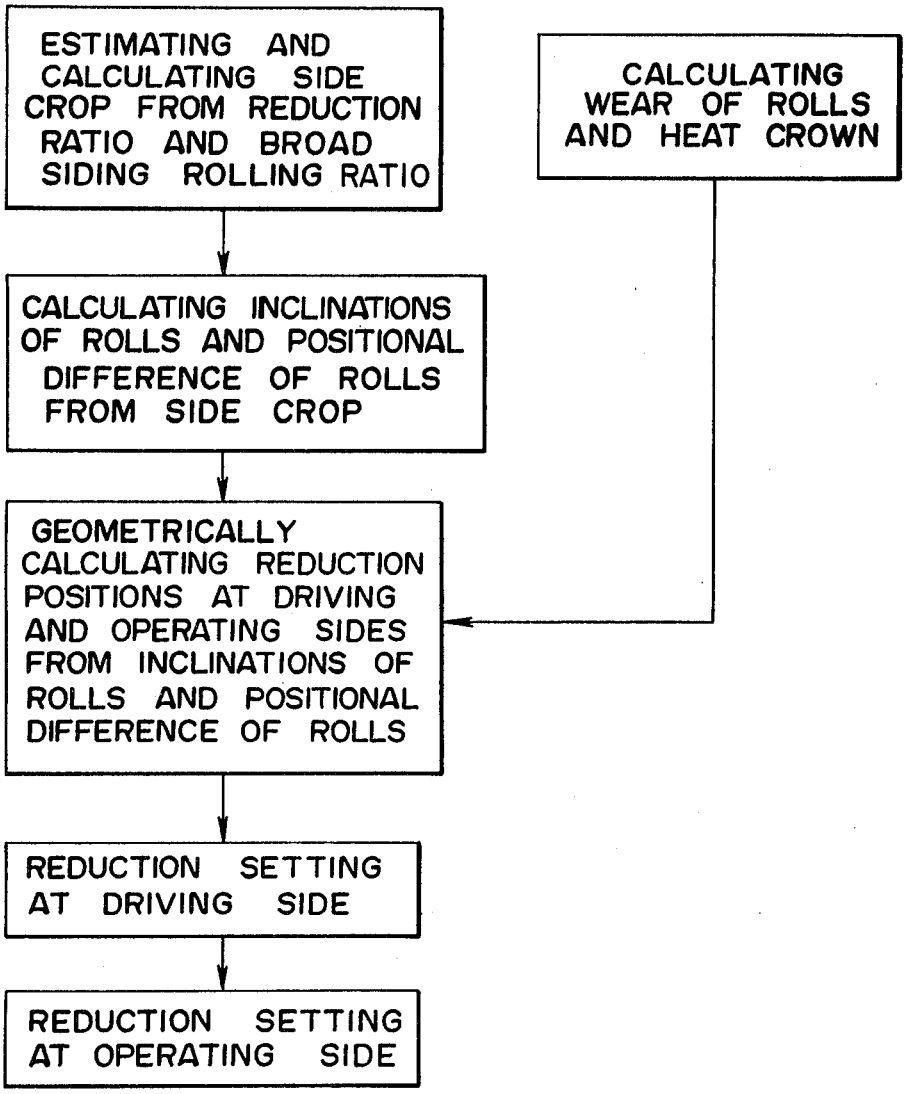
FIG. 8 is a flow chart showing the outline of the process to calculate the desired angle of the work rolls.
Figure 9:
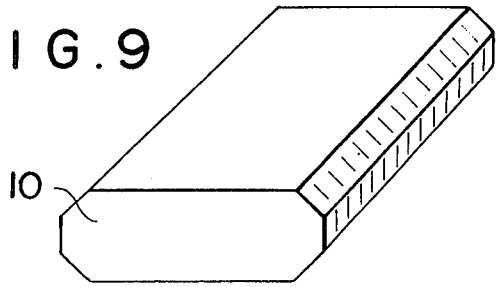
FIG. 9 is a perspective view showing an example of the material which has been rolled by the plate rolling of the invention.

Description will hereunder be given of operation of said control unit. Firstly, reduction positions at the driving and operating sides are calculated by the process computer 18 as shown in FIG. 8. The process computer 18 feeds an inclined reduction signal to the reduction control system 17 based on the result of the aforesaid calculation. Upon receipt of the signal, the reduction control system 17 turns off the electromagnetic clutch 22, and at the same time, feeds a clutch turn-off completion signal to the process computer 18. Upon receipt of said clutch turn-off completion signal, the process computer 18 feeds a reduction setting value to the automatic reduction setting devices at the driving and operating sides, respectively. The respective automatic reduction setting devices 19 compare the reduction setting value from the process computer 18 and the actual reduction positions from the reduction position sensors 28 and the encoders 20 and feed the deviation to the reduction control system 17 so as to control the reduction positions to coincide with the setting positions. Upon completion of this control, a required reduction screw 27 at either the driving side or the operating side is driven by the motor 23 to press down one of the roll chocks 15, whereby the work roll 11 is inclined so that a difference can be given in roll gap between the work rolls 11 and 12 in the axial direction. Under this condition, the end portion at one side is subjected to a one-side plate rolling by the invention, and thereafter, the end portion at the other side is subjected to the one-side plate rolling by the invention similarly to above. Further, if the opposite end portions at the other surface are subjected to the plate rolling of the invention similar to the above, then the material 10 having a satisfactory shape of plate rolling of the invention as shown in FIG. 9 is obtainable.

It should be fair to state that any reduction control unit other than that described above may be used.

In addition, the value for plate rolling of the invention at each end portion at each side surface of the material 10 may be separately controlled according to the requirement.

Furthermore, the present invention is applicable to the rolling in which the axis of the material to be rolled is made to be the rolling width (a so-called rolling in the transverse direction). More specifically, under the same idea as in the ordinary rolling in the longitudinal direction, the plate rolling of the invention is carried out with the difference in gap between the work rolls in the axial direction thereof corresponding to the difference in side crop upon completion of the broadside rolling or before the broadside rolling, so that the side crop can be decreased.

Further, in the case the material has a widthwise tapered shape in the longitudinal direction, if the broadside rolling is carried out, then the difference in width remain as they are. However, according to the present invention, with the material as described above, the plate rolling of the invention is carried out with the difference in gap between the work rolls in the axial direction thereof corresponding to the difference in width upon completion of the broadside rolling or before the broadside rolling, so that the difference in width as described above can be obviated.

Further, in the case slabs are produced from an ingot in a slabbing mill, if the ingot has a widthwise tapered shape, then the slab is also has a difference in width in tapered-like shape under the influence of the ingot. However, the present invention is also effective in avoiding the abovedescribed difference in width. More specifically, in the process of slabbing rolling, the ingot is subjected to the rolling in the transverse direction relative to the axis of ingot, and at the same time, the plate rolling of the invention is carried out with the difference in gap between the work rolls in the axial direction thereof corresponding to the difference in width, so that the difference in width can be eliminated.

From the foregoing description, it should be apparent to one skilled in the art that the abovedescribed embodiment is but one of many possible specific embodiments which can represent the applications of the principles of the present invention. Numerous and varied other arrangements can be readily devised by those skilled in the art without departing from the spirit and scope of the invention.

What is claimed is:

1. A method for manufacturing a heavy plate having no side crop portions bulging outwardly by rolling a rectangular slab, comprising the steps of:

rolling said slab in the longitudinal direction thereof;

rolling said slab in the lateral direction perpendicular to the longitudinal direction of said slab;

rolling opposite end portions of said slab by upper and lower rolls in said lateral direction of said slab with a gap between said upper and lower rolls being tapered toward axially outer directions of said upper and lower rolls so that said end portions are bevelled, whereby each corner of said end portions projects outwardly; and forming said heavy plate by rolling said slab having bevelled end portions in said longitudinal direction of said slab.

2. A method for manufacturing a heavy plate as set forth in claim 1, wherein the step of rolling opposite end portions is carried out after the step of rolling said slab in the lateral direction.

3. A method for manufacturing a heavy plate as set forth in claim 1, wherein the step of rolling opposite end portions is carried out before the step of rolling said slab in the lateral direction.

4. A method of plate rolling as set forth in claims 1 to 3, wherein, as for the value corresponding to the difference in width between the center and the end portions of the material to be rolled, the difference ΔSo in position between the right and left screws or the rolls is given by:

$$\Delta So = \left(\frac{L+l}{2} - \beta \cdot l\right) \times \frac{\Delta W \cdot t}{\beta \cdot l \cdot Ws} + (GM - So)$$

and the inclination $\alpha$ of the upper work roll from the horizontal direction is given by:

$$\alpha = \tan^{-1} \frac{\Delta W \cdot t}{\beta \cdot l \cdot Ws}$$

wherein

So: positions of the screws immediately after broadside rolling,

GM: a thickness of the material immediately after broadside rolling, l: a length of the material to be rolled immediately after broadisde rolling, $\beta$: a side crop correction factor, L: a distance between the centers of the roll bearings, Ws: a width of the material to be rolled immediately after broadside rolling, t: a thickness of the material to be rolled upon completion of the broadside rolling $$\Delta W = \int (W_r/Ws, \Delta Ts, \Delta R)$$

($W_r$: a required rolling width, $W_r/Ws$: a broadside rolling ratio,

ΔTs: a reduction of sizing rolling,

ΔR: a variable value in the roll profile)

* * * * *